US005725732A

United States Patent [19]

Cooper, III

[11] Patent Number: 5,725,732

[45] Date of Patent: Mar. 10, 1998

[54] PROCESS FOR TREATING HARDWOOD PULP WITH AN ENZYME MIXTURE TO REDUCE VESSEL ELEMENT PICKING

[75] Inventor: Elwood W. Cooper, III, Dover, Pa.

[73] Assignee: P. H. Glatfelter Company, Spring Grove, Pa.

[21] Appl. No.: 677,276

[22] Filed: Jul. 9, 1996

Related U.S. Application Data

[63] Continuation of Ser. No. 344,582, Nov. 18, 1994, abandoned.

[51] Int. Cl.[6] ..... D21H 25/02

[52] U.S. Cl. ..... 162/72; 162/134; 435/277; 435/278

[58] Field of Search ..... 162/72, 134; 435/277, 435/278

[56] References Cited

U.S. PATENT DOCUMENTS

| | | | |
|---|---|---|---|
| 4,923,565 | 5/1990 | Fuentes et al. . | |
| 5,110,412 | 5/1992 | Fuentes . | |
| 5,116,474 | 5/1992 | Fuentes et al. | 162/72 |
| 5,116,746 | 5/1992 | Bernier et al. | 435/172.3 |
| 5,179,021 | 1/1993 | du Manoir et al. | 435/278 |
| 5,202,249 | 4/1993 | Kluepfel et al. | 435/201 |
| 5,308,449 | 5/1994 | Fuentes . | |
| 5,395,765 | 3/1995 | Dahlberg et al. . | |
| 5,407,827 | 4/1995 | Casimir-Schenkel . | |

FOREIGN PATENT DOCUMENTS

| | | | |
|---|---|---|---|
| 0 351 655 | 7/1989 | European Pat. Off. | 162/72 |
| 0 430 915 | 11/1990 | European Pat. Off. | 162/72 |
| WO 91/02839 | 3/1991 | WIPO . | |

OTHER PUBLICATIONS

PULPZYME™ HA, Brochure, "Natural Pulping", Sep. 1989.

Noe, P., et al., J. Wood Chem. Ind. Tech., 6(2), (1984), pp. 167 to 184.

International WO 91/02839, PCT/DK90/00220.

Noe, P. et al., "Action of Xylanases On Chemical Pulp Fibers", J. Wood Chem. Tech., 6 (2), (1986), pp. 167 to 184.

Holm, Hans C., "The Use Of Enzymes In The Pulp And Paper Industry," World Pulp & Paper Technology 1994, (1993), pp. 181 to 183.

"Development Of Bleaching Technology In Finland", Paperi ja Puu, 74, No. 2, (1992), pp. 102 to 106.

Pedersen, Lars Saaby, et al., "Bleach Boosting Of Kraft Pulp Using Alkaline Hemicellulases," A-06152, (Apr. 1991), 15 pages.

Abstract of Ishizaki, H., Jpn. Tappi,J., 46, No. 1, (Jan. 1992), pp. 149 to 155.

Abstract of Uchimoto, I., et al., Jpn. J. Pap. Technol. No. 2, (Feb. 1990), pp. 1 to 5.

Chambers' Technical Dictionary, 3rd Ed., (1959), p. 479.

The Condensed Chemical Dictionary, 10th Ed., pp. 535, 595 and 870.

Industrial Chemistry, 4th Ed., vol. Two, (1926), pp. 1063 and 1064.

Shreve, R. Norris, 2nd Ed., (1956), pp. 721 to 723 and 727 to 729.

Senior, D.J., et al., "Use Of Xylanases To Decrease The Formation Of AOX In Kraft Pulp Bleaching", J. Of Pulp And Paper Science, vol. 18, No. 5, (Sep. 5, 1992), pp. J165 to J169.

A brochure entitled "Vesselex" Enzyme For The Paper Industry, SolvayBiosciences Pty. Ltd, 11 pages.

A brochure "Pulpzyme HA", Novo Enzyme Process Division, (front page).

(List continued on next page.)

*Primary Examiner*—Steven Alvo

*Attorney, Agent, or Firm*—Fisher, Christen & Sabol

[57] ABSTRACT

The process uses a mixture of cellulases and xylanases to chemically change the hardwood vessel elements, rendering them susceptible to breaking under normal mill refining, thus not requiring any additional refining equipment. The process involves treating hardwood brownstock (unbleached) pulp with a cellulase/xylanase mixture. The use of a pure cellulase enzyme is excluded.

25 Claims, 1 Drawing Sheet

OTHER PUBLICATIONS

A brochure "Pulpzyme HB", Novo Nordisk, Enzyme Process Division, (front page).

A brochure "SP 476", Novo Nordisk, Enzyme Process Division, (Mar. 1992).

A brochure "Celluclast 1.5L", Novo Nordisk, (Dec. 1990).

PROCESS FOR TREATING HARDWOOD PULP WITH AN ENZYME MIXTURE TO REDUCE VESSEL ELEMENT PICKING

This application is a Continuation of prior U.S. application Ser. No. 08/344,582, filed Nov. 18, 1994, now abandoned.

BACKGROUND OF THE INVENTION

1. Field of the Invention

The invention relates to a process for treating hardwood pulp with enzymes to reduce vessel element picking.

2. Background Art

Hardwood pulp is used in the paper industry to produce a variety of end products. Some of these products are designed specifically for the printing and book publishing industries. The paper used in these industries has a high content of hardwood pulp which gives good formation, opacity and printability. However, one problem with regard to the use of hardwood pulps results from their basic structure. Hardwoods contain two principle cell types. These are fiber cells and vessel element cells. The non-fibrous vessel cells transport water throughout the entire tree. They do not add strength or quality to the paper and, therefore, are not desirable. The structures remain intact through the pulping, bleaching and refining processes. During the papermaking process, these vessels can remain on the paper surface and not bonded to the fibers. The problem in printing is that the large unbonded vessel elements on the surface of the sheet get picked out by the printing press during the printing operation. This results in ink not being applied to all parts of the paper where it was intended to be applied. The vessels could also remain on the roll causing voids or spots to form. The net result is that the paper is of unacceptable quality.

In the past, vessel picking problems have been addressed using sizing, coating or refining technologies. The first two approaches have been unsuccessful in fully combating this problem and the latter approach tends to require significant amounts of capital and energy. Refining tends to be the most successful in reducing vessel picking (although high reductions have not been achieved). Many mills are reluctant to spend the capital required to reduce this problem. Therefore, combating this problem has become an issue that is not only costly in the industry, both to tolerate and to prevent, but usually goes unaddressed or accepted as normal.

Enzymes have been used in many different applications, and one in particular in the pulp and paper industry. Xylanase enzymes have been used to improve the bleachability of kraft pulps. These enzymes attack the reprecipitated xylan and allow better accessibility to delignify and bleach the pulp. Early work in this technology used xylanase enzyme preparations that had significant cellulase activity. These cellulases supposedly actively broke down the usable pulp fiber and reduced the fiber strength. Therefore, enzyme suppliers were heavily encouraged to remove any cellulase activity and purify the xylanases.

U.S. Pat. No. 5,202,249 (Kluepfel) involves a process using an endo-xylanase enzyme, having a high specific activity, for the treatment and/or biobleaching of lignocellulosic pulps. It is asserted that improved brightening and delignification is achieved. Kluepfel states:

"Preferably, the endo-xylanase is substantially cellulase-free. By the term 'substantially cellulase-free' is meant those systems which do not contain sufficient amounts of cellulase to effect the unfavourable hydrolysis of glucosidic linkages present in the cellulose when the enzyme is applied to cellulose pulps."

"It is also preferable that the endo-xylanase is obtained from a host microorganisms wherein the host microorganisms mutant strain is characterized by it having a cellulase-negative activity. Cellulase-negative, when used in this context, is defined as a strain which produces a cellulase-free xylanase which is essentially free from extracellular cellulase." [Col. 2, line 65, to col. 4, line 9]

U.S. Pat. No. 5,116,746 (Bernier et al.) discloses a process using a cellulase-free endo-xylanase for the treatment of lignocellulosic material for delignification, brightening and viscosity improvement. A cellulase-negative microorganism overexpresses the xylanase gene to provide the endo-xylanase.

U.S. Pat. No. 5,179,021 (du Manoir et al.) discloses bleaching lignocellulosic material by oxygen bleaching followed by an enzymatic treatment with a substantially cellulase-free xylanase. Du Manoir et al. stated that, in the manufacture of pulp for the purpose of paper-making, the effect of a cellulase enzyme would be detrimental owing to the resulting decrease in the degree of polymerization of the cellulose that would occur. In du Manoir et al., when an enzyme mixture containing xylanase also contains substantial amounts of cellulase, the cellulase is removed by any method known for the purification of xylanase, or the cellulase is selectively rendered inactive by any acceptable chemical or mechanical treatment.

Holm, Hans C., "The Use Of Enzymes In The Pulp And Paper Industry," World Pulp & Paper Technology 1994, (1993), pages 181 to 183, discloses the use of xylanase as being beneficial for subsequent bleaching purposes. Pulpzyme HB is said to work best at around neutral pH. (Pulpzyme HB is a xylanase preparation which is virtually free of cellulase activity, i.e., a trace or less, about 10 EGU/g.) The Holm article, in discussing possible future applications, said that it has been reported that cellulases reduce the amount of energy required to beat mechanical pulp and that treating pulp with a cellulase improves the dewatering of the paper web on a paper machine. (Nowhere in the Holm article is a combination cellulase and xylanase described.)

"Development Of Bleaching Technology In Finland", Paperi ja Puu, 74, No. 2, (1992), pages 102 to 106, discloses treating hardwood pulp with xylanase at pH 4 to 7 and 50° to 70° for 1 to 3 hours whereby there was a reduction of bleaching chemicals in the subsequent bleaching step.

Pedersen, Lars Saaby, et al., "Bleach Boosting Of Kraft Pulp Using Alkaline Hemicellulases," A-06152, (April 1991), 15 pages, discloses that alkaline xylanase preparations completely free of cellulase activity boost the bleachability of softwood kraft pulp. The two alkaline xylanases showed good bleach boosting effects at pH 8 and 9, respectively. Brownstock pulp is treated before the conventional bleaching sequence. The article mentions literature dealing with the use of hemicellulases for bleach boosting application. Such enzymes worked at acid pH (4 to 5) and apparently required long treatment times (12 to 24 hours).

There are two abstracts of a Japanese article that describe the use of a cellulase enzyme to reduce the vessel picking of pulp. The abstracts mention that the treatment was especially effective on eucalyptus which is a hardwood. The pure cellulase enzyme used in the Japanese article is marketed under the name Vesselex. Vesselex is stated to be used for the suppression of vessel pick formation. The abstracted article is *Ishizaki, H.*, Jpn. Tappi J., 46, No. 1, (January 1992), pages 149 to 155.

There is an abstract of *Uchimoto, I., et al.*, Jpn. J. Pap. Technol., No. 2, (February 1990), pages 1 to 5, that describes the use of Vesselex (a Trichoderma cellulase) to treat pulp to improve vessel picking.

BROAD DESCRIPTION OF THE INVENTION

The objective of the invention is to provide a method for treating hardwood pulp with an enzyme mixture prior to bleaching and refining which will reduce vessel element picking on the paper machine without significant pulp degradation. Other objectives and advantages of the invention are set out herein or are obvious herefrom to one skilled in the art.

The objectives and advantages of the invention are achieved by the process of the invention.

The invention process uses a mixture of cellulases and xylanases to chemically change the hardwood vessel elements, rendering them susceptible to breaking under normal mill refining, thus not requiring any additional refining equipment. The process involves treating hardwood brownstock (unbleached) pulp with a cellulase/xylanase mixture. The pulp treatment is done prior to bleaching and refining. The prior art generally did not use cellulase-containing enzymes for fear of pulp degradation. The invention has the goal of substantial vessel pick reduction without significant pulp degradation. The invention excludes the use of a pure cellulase enzyme (for example, Vesselex) and the use of a xylanase which is substantially free of cellulase activity. Xylanases are hemicellulases. The concomitant use of cellulases and xylanases in the proper proportions is a core factor of the invention.

As used herein, the term "cellulase/xylanase mixture" means that the enzyme mixture contains a substantial amount of cellulases, namely, at least a sufficient amount of cellulases to achieve substantial hydrolysis of the glucosidic linkages in the cellulose when the enzyme mixture is applied to aqueous cellulose pulps. Cellulase-free xylanases and xylanase-free cellulases are not within the scope of the invention process. In the cellulase/xylanase mixture, both the cellulases and xylanases are active.

Preferably the cellulase/xylanase mixture is obtained by natural expression from a microorganism, as opposed to a cellulase/xylanase mixture prepared by mixing the individual enzymes.

DETAILED DESCRIPTION OF THE INVENTION

Figure 1:
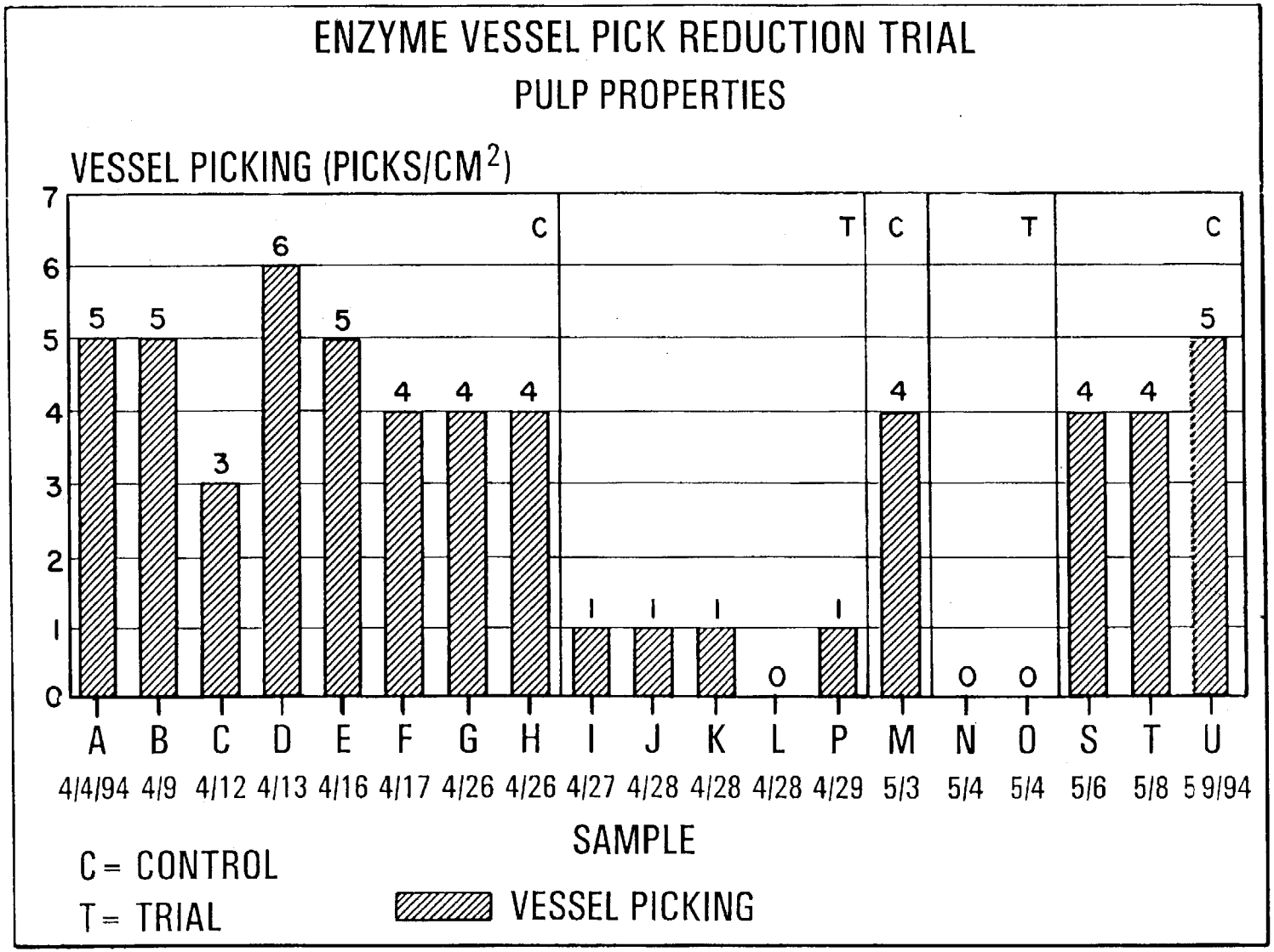
FIG. 1 is a graph of enzyme vessel pick reduction in a mill trial.

The aqueous hardwood pulp slurry can, for example, be that of northern or southern hardwood. While is it preferred to employ a kraft pulp, other chemically digested pulps and mechanically-prepared pulps can be used. An unbleached pulp is used. The hardwood pulp can be prepared typically in a digester in the presence of chemicals such as sodium hydroxide and sodium sulfide (to produce a kraft pulp) or sulfites, usually sodium or magnesium, (to produce a sulphite pulp). (Kraft pulp is often prepared by digestion with a mixture of caustic soda, sodium carbonate and sodium sulfide.) The removal of lignin content of wood pulps is measured by a permanganate oxidation test according to a Standard Method of the Technical Association Of The Pulp And Paper Industry (TAPPI), and is reported as a Kappa Number. The chemical pulp from the digester still contains an appreciable amount of residual lignin at this stage, and in some cases is suitable for making construction or packaging paper without further purification. For the manufacture of printing and book publishing papers, however, the pulp is too dark in color and must be delignified and brightened by bleaching. It is at this point that the process of the present invention can be employed, i.e., before the bleaching of the lignocellulosic material, said material referred to herein as chemical hardwood brownstock pulp.

There are four different kinds of wood pulp: mechanical or chemimechanical pulp, sulfite pulp, sulfate or Kraft pulp, and soda pulp. The first is prepared by purely mechanical (or semi-mechanical) means, the other three by chemical means. The mechanical pulp contains all of the wood except the bark. Chemical pulps, however, are essentially pure cellulose, the undesirable lignin and the other noncellulosic components of the wood having been dissolved away by the treatment. Because of this, chemical pulps are much superior to mechanical (or groundwood pulp) for fine papermaking.

It has been found that treating hardwood brownstock pulp with an enzyme mixture containing primarily xylanase, but with substantial cellulase activity, chemically affects the vessel elements so that they are more susceptible to breaking through normal mill refining.

Unbleached hardwood brownstock is treated with an enzyme mixture in a manner that simulates the brownstock high density storage tower. The brownstock is at a consistency between 5 and 12 percent. The pulp is pH adjusted (if necessary) to a range of 4 to 10, with either acid or alkali, that corresponds with the optimum pH range for that specific enzyme mixture. The pulp is at a temperature between 100° to 154° F. (52° to 68° C.) for a reaction time of 30 to 180 minutes. The temperature also corresponds to the optimum temperature of the specific enzymes used. When the enzyme mixture is added to the pH adjusted pulp, mixing takes place as performed by a thick stock pump. The mixture can be agitated at various speeds with the use of various mixing devices which simulate a thick stock pump. The cellulase/xylanase mixture can be applied as it is produced in a fermentation broth, or a concentrated form thereof, or as a composition prepared from either a more concentrated composition of the cellulase/xylanase mixture or a dried preparation of the cellulase/xylanase mixture. Thereafter, preferably no mixing takes place, simulating high density pulp storage and normal mill conditions. High density storage towers normally have poor or no mixing. The unbleached hardwood pulp can be enzyme treated in one or more stages. After enzyme treatment, the pulps are fully bleached to a GE or TAPPI brightness of 80 percent or greater for use in the printing and book publishing industry.

The invention enzyme treatment effectively reduces hardwood vessel picking in fully bleached hardwood pulp handsheets by up to 70 percent or more. The enzymes can be chosen so as to vary the amount of vessel picking reduction, if desired. While the enzyme mixtures effectively reduce vessel picking, the pulp strength properties of Instron tensile (breaking length), tear (Elmendorf) and burst (Mullen) have not been negatively affected.

The hardwood pulp usually is a pulp of a species of oak, maple, poplar, birch, chestnut, aspen, beech, walnut, eucalyptus or mixtures thereof.

The hardwood pulp is produced from the Kraft process, Sulfite process, or any other commercially feasible process. Preferably the hardwood pulp is a chemically-digested hardwood pulp, most preferably (unbleached) hardwood Kraft pulp.

The consistency of the hardwood brownstock (bleached) pulp to be treated is usually from about 0.1 to about 30 weight percent, preferably about 2 to about 12 weight percent, based upon the oven-dry (O.D.) weight of the pulp.

The acid to adjust the pH of the hardwood pulp before the enzyme treatment can be any suitable inorganic or organic acid which does not have an adverse effect on the enzyme treatment of the hardwood pulp. Examples of suitable inorganic acids are sulfuric acid, sulfurous acid, nitric acid, nitrous acid, phosphoric acid, phosphorous acid and mixtures thereof. The preferred inorganic acid is sulfuric acid. Chlorine-containing acids should be avoided when Pulpzyme HA is used. Examples of suitable organic acids are benzoic acid, bromoacetic acid, maleic acid, formic acid, lactic acid, malic acid, acetic acid, butyric acid, propionic acid, citric acid, oxalic acid, succinic acid, picolinic acid and mixtures thereof. The preferred organic acid is acetic acid.

The base used to adjust the pH of the hardwood pulp before the enzyme treatment can be any suitable inorganic or organic base which does not have an adverse effect on the enzyme treatment of the hardwood pulp. Examples of suitable inorganic bases are sodium hydroxide, zinc hydroxide, ammonium hydroxide, aluminum hydroxide, potassium hydroxide and mixtures thereof. The preferred inorganic base is sodium hydroxide. Examples of suitable organic bases are aniline, tripropylamine, ethylamine, propylamine, acetamide, acetanilide, diethylamine, methylamine and mixtures thereof. The preferred organic base is ethylamine.

As used herein, acids are usually defined as being substances whose molecules ionize in water solution to give the hydrogen ion(s) from their constituent elements. As used herein, bases are usually defined as being substances which ionize in water to give the hydroxyl ion(s) from their constituent elements.

Preferably an enzyme mixture is used which has an optimum pH range of 6 to 8, particularly preferred of 7 to 8.

The enzyme mixture used is a mixture of cellulase and xylanase enzymes—there must be a substantial cellulase activity. The term cellulase includes all varieties of cellulases, endo and exo. The term xylanase includes all varieties of xylanases, endo and exo. The enzyme mixture can contain other enzymes than cellulases and xylanases. However, the cellulase is not the primary component. Xylanase is the primary component of the mixtures. The enzyme mixtures can be of bacterial or fungal origin. The cellulase/xylanase mixture should have a cellulase activity of at least 200 EGU/g, preferably at least about 300 EGU/g, and a xylanase activity of at least 200 XYU/g, preferably at least 300 XYU/g and best at about 500 XYU/g.

The most preferred cellulase/xylanase enzyme mixture is Pulpzyme HA, which is produced by the microorganism *Trichoderma longbrachiatum*. It is a product of Novo Nordisk Bioindustrials Inc., Enzyme Process Division, of Connecticut. The preferred operative pH for the enzyme mixture is 7. Pulpzyme HA is a brown liquid preparation. The Pulpzyme HA enzyme mixture contains xylanases, that is, endo-xylanase (endo-1,4-beta-D, specifically EC 3.2.1.8) and exo-xylanase (exo-1,4-beta-D, specifically EC 3.2.1.37), cellulases, that is, endo-glucanase (possibly 2 or 3 types), cellobiohydrolase (possibly 2 or 3 types) and beta-glucosidase (possibly 2 or 3 types), acetyal esterase and alpha galactosidase. The cellulase/xylanase enzyme mixture has low activity towards crystalline cellulose. One xylanase unit (XYU) is defined as the amount of enzyme which under standard conditions (pH 3.8, 30° C., 20 min. incubation) degrades larchwood xylan to reducing carbohydrates with a reducing power corresponding to 1 μmol xylose. One endo-glucanase unit (EGU) is defined as the amount of enzyme which under standard conditions (pH 6.0, 40° C., 30 min. incubation) lowers the viscosity of a carboxymethyl cellulose solution to the same extent as an enzyme standard defining 1 EGU. The Pulpzyme HA is standardized to a xylanase activity of 500 XYU/g and contains a cellulase activity of about 300 EGU/g. (A trace cellulase activity would be less than 50 EGU/g.)

At a temperature of 40° C. and a reaction time (in a pulp) of 20 minutes, the xylanase in Pulpzyme HA exhibits a relative activity of 60 percent or more at a pH of 3.5 to 6 (a pH range of 4 to 5 gives a greater xylanase activity/effect). A product brochure for Pulpzyme HA of Novo Nordisk Bioindustrials Inc., Enzyme Process Division, states: "By proper selection of process conditions (e.g., pH 6.5, 45° C.) undesirable effects of the cellulase activity may be further reduced." FIG. 2 in the product brochure shows almost zero percent relative cellulase activity and about 40 percent relative xylanase activity at pH 7. While theoretically there should be little or no cellulase activity at about pH 7, the invention secured the best results at about pH 7 when using Pulpzyme HA. The preferred pH for Pulpzyme HA is about 7 to 8, although a range of 6 to 8 gives good results.

A preferred cellulase/xylanase enzyme mixture is SP 342. The multi-enzyme complex known by the designation/name SP 342 includes cellulase, glucanase, hemi-cellulase and pentosanase activities. SP 342 is a product of Novo Nordisk Bioindustrials Inc., Enzyme Process Division. SP 342 is usually in the form of a stabilized liquid preparation. A brochure says that SP 342 is active in slightly acidic to mild alkaline conditions and at moderate temperatures. FIG. 1 in the brochure shows about 100 percent relative activity in the pH range of 5 to 7.

The process uses conditions which correspond with the activity ranges of the enzymes used. The enzyme dosage is effective even at 0.1 weight percent of fiber or less.

The hardwood pulp is treated with the enzyme prior to bleaching and refining. The enzyme can be inhibited after the treatment by heating the pulp to a sufficient temperature. At the end of the time period for the cellulase/xylanase treatment, the resultant treated material can be used directly or thickened, and the treated material then used for further processing.

The enzyme treated pulp is bleached to a GE or TAPPI brightness of 80 or greater and refined prior to the paper machine. The pulp is subsequently treated in various ways depending upon the type of paper desired.

The conventional method for further delignifying and bleaching pulp has been to employ a variety of multi-stage bleaching sequences, including anywhere from three to six stages, or steps, and with or without washing between steps. The objective in bleaching is to provide a pulp, in the case of chemical pulps, of sufficiently high brightness and strength for the manufacture of paper and tissue products. Characteristically, pulps of GE or TAPPI brightness of 80 to 86 percent are produced. The bleaching sequences can be based on the use of chlorine and chlorine-containing compounds, in one form or another. Some of the chlorine-containing compounds that are used are chlorine, chlorine dioxide, and hypochlorites, usually sodium hypochlorite. Chlorine, with or without admixture of chlorine dioxide, is commonly employed to initiate the bleaching of chemical pulp, followed by extraction of the chlorine-treated pulp in an aqueous alkaline medium. Also oxygen can be used as the delignifying and bleaching agent. One application is the use of oxygen in conjunction with a conventional alkaline extraction stage.

The resultant paper product is any paper that ink is applied to and vessel picking will reduce the quality of the paper, such as, printing and book publishing papers.

Vesselex is a liquid cellulase preparation standardized at 100 U/g FPase which is marketed by Solvay Biosciences Pty. Ltd., Victoria, Australia. When hardwood pulp (Eucalyptus) is used as the raw material for the manufacture of paper, the vessels which remain in the paper cannot properly accept the ink during printing and the ink at the site of the vessels comes off causing the vessel pick phenomena. Solvay Biosciences asserts that Vesselex is a cellulase enzyme which has been specially developed to reduce the formation of vessel picks in paper manufactured from hardwood pulp. The process of using Vesselex in the paper industry uses pulp thickening and then enzyme (from an enzyme holding tank at 5° C.) added to white water which is fed to a static mixer and the mixture is then added to a pulp chest which is sent to a refinery. The stated conditions were: pulp concentration, 5 to 6 percent; pH, 5.0 to 5.5; enzyme dose, 0.02 to 0.03 percent (w/w); temperature, 30° to 40° C.; and reaction time, not less than 4 hours. Regarding the prevention of vessel pick formulation by Vesselex cellulase: at an enzyme dosage of zero percent (w/w), the vessel picks were 185 (count per 10 sqr. cms.); at an enzyme dosage of 0.1 percent, the vessel picks were 18; and at an enzyme dosage of 0.2 percent, the vessel picks were 22. It is reported that, as the Vesselex cellulase dosage increases, the pulp degradation increases, but at the ideal dosage of 0.03 to 0.05 percent there is almost no pulp loss. It is also reported that the Vesselex cellulase is completely inactivated in one minute under normal machine drying conditions at 120° C.

Vesselex is used for the prevention of vessel pick formation. However, the invention is different, for example, because of different conditions: pH (5.0 to 5.5, Vesselex vs. pH 6 to 8, invention), temperature (30° to 40° C., Vesselex vs. 52° to 68° C., invention), reaction time (4 hours, Vesselex vs. 0.5 to 3 hours, invention), and pulp concentration (5 to 6 percent, Vesselex vs. 5 to 15 percent, invention). Most importantly, cellulase use can prove detrimental for paper properties other than vessel picking, and thus its use should be minimized. The disclosed discovery allows for the beneficial end product of vessel picking by using decreased levels of cellulase activity, and thus reducing the detrimental effects of cellulase use.

Bernier et al. (U.S. Pat. No. 5,116,746) used a cellulose-free endo-xylanase enzyme (obtained from a cellulase-negative recombinant microorganism) for pulp delignification. The endo-xylanase may contain a trace of cellulase which in activity terms is zero to 50 EGU/g (the higher the activity, the larger the amount of cellulase). The endo-xylanase is basically and relatively a single component enzyme composition. Bernier et al. uses host microorganisms of the species *Streptomyces lividans* for transformation to the cellulase-negative recombinant microorganism which has cellulase-negative activity. In the Bernier et al. process, there is continuous mixing of the pulp and enzyme throughout the reaction time. The Bernier et al. process is illustrated with treatment times of a day or more. Bernier et al. states that its purified endo-xylanase has a "pH of 5.2." The invention uses a cellulase activity (about 300 EGU/g or greater) so it is a true enzyme mixture. The cellulase/xylanase mixture of the invention preferably is produced/expressed by the microorganism Trichoderma (although other cellulase/xylanase mixtures having substantial cellulase activity obtained from other microorganism sources can be used). The microorganism sources of the cellulase/xylanase mixtures useful in the invention have cellulase-positive activity. The invention process preferably initially mixes the pulp and enzyme mixture and then lets the admixture stand. The invention process preferably uses a reaction time of 1 to 2 hours. The invention process preferably uses a pH of 6 to 8.

Celluclast 1.5 L is a liquid cellulase preparation made by submerged fermentation of a selected strain of the fungi *Trichoderma Reesi*. It is a product of Novo Nordisk A/S, Bioindustrial Group, Enzyme Process Division, of Denmark. A product brochure by such company states that the optimum working pH is 4.5 to 6.0.

SP 476 is an endo-1.4-beta-D-glucanase (EC 3.2.1.4) preparation produced by submerged fermentation of a selected strain of fungal origin. It is a product of Novo Nordisk Bioindustrials Inc., Enzyme Process Division, of Connecticut. A product brochure by such company states that the maximum activity in the pH range is 5.0 to 9.0.

EXAMPLE 1

Laboratory scale work was performed on vessel elements that were separated from unbleached hardwood fiber and treated with a cellulase/xylanase enzyme mixture (SP 342). Both treated and untreated vessels were analyzed by Fourier Transform Infrared Analysis (FTIR) to determine if the enzymes had any effect on the vessels. The spectra received from the analysis showed that the enzymes were breaking —OH bonds (i.e., breaking glycolytic ester linkages, $R_1$—O—$R_2$ linkages) and forming —$CONH_2$ bonds. The analysis also showed that aromatic rings may have been broken by enzyme treatment. These changes in the chemical structure of the vessels will weaken the wall strength and make the vessels more susceptible to breaking under mechanical forces, such as, normal mill refining. The enzymes did not actually break the vessels at this point, but apparently weakened the wall integrity.

EXAMPLE 2

Hardwood brownstock pulp was treated with two different enzymes and enzyme mixtures at varying levels prior to refining. A purified cellulase (Celluclast 1.5 L) and a cellulase/xylanase mixture No. 1 (SP 342) were used separately under specific pH control (cellulase: 4.6, and the cellulase/xylanase mixture No. 1: 6.0) for one hour at 130° F. with no intermittent mixing throughout the reaction. Thorough mixing took place at the initiation of the reaction, but no mixing was used throughout the remainder of the reaction time. After enzyme treatment, the pulps were refined by a PFI Mill to a standard 35° S—R freeness and Tappi handsheets prepared. The handsheets were tested by an IGT testing instrument by IGT/Reprotest B.V. This instrument allows vessel picking to be observed and quantified. The results are set out in the following table:

TABLE 1

| Trial[1] | pH | Average Vessel Picks/cm$^2$ | Standard Deviation | % Reduction |
|---|---|---|---|---|
| Control | — | 4.0 | 0.8 | 0 |
| Cellulase, 0.01% | 4.6 | 5.8 | 0.5 | 0 |
| Cellulase, 0.10% | 4.6 | 3.5 | 0.6 | 12 |
| Cellulase/xylanase mixture #1, 0.01% | 6.0 | 3.2 | 0.9 | 40 |
| Cellulase/xylanase mixture #1, 0.10% | 6.0 | 1.3 | 0.5 | 68 |

Note:
[1]Weight percent of enzyme or enzyme mixture, based on the weight of the hardwood brownstock pulp, assuming 100 percent activity of the enzymes.

EXAMPLE 3

Hardwood brownstock pulp was treated with several different enzymes and mixtures at varying levels prior to refining. The same purified cellulase (Celluclast 1.5 L) in Example 2 and the cellulase/xylanase mixture No. 1 (SP 342) from Example 2, a glucanase (SP 476), and a cellulase/xylanase mixture No. 2 (Pulpzyme HA) were used separately under specific pH (cellulase: 5.5, cellulase/xylanase mixture No. 1: 6.0, glucanase: 7.0, and cellulase/xylanase mixture No. 2: 7.0) control for one hour at 130° F. with no intermittent mixing throughout the reaction. Thorough mixing took place at the initiation of the reaction, but no mixing was used throughout the remainder of the reaction time. After enzyme treatment, the pulps were refined by a PFI Mill to a standard 35° S—R freeness and Tappi handsheets prepared. The handsheets were tested by an IGT testing instrument by TGT/Reprotest B.V. This instrument allows vessel picking to be observed and quantified. The results are set out in the following table.

TABLE 2

| Trial | Average Vessel Picks/cm$^2$ | Standard Deviation | % Reduction |
|---|---|---|---|
| Control | 4.8 | 0.8 | 0 |
| Cellulase #1 | 4.3 | 0.5 | 10 |
| Glucanase | 2.2 | 0.4 | 54 |
| Cellulase/xylanase mixture #2 | 1.5 | 0.6 | 69 |
| Cellulase/xylanase mixture #1 | 2.2 | 0.8 | 54 |

EXAMPLE 4

Hardwood brownstock pulp was treated with several different enzymes and mixtures at varying levels prior to refining. The cellulase/xylanase mixture No. 1 (SP 342), the glucanase (SP 476), and the cellulase/xylanase mixture No. 2 (Pulpzyme HA) were used separately under specific pH (cellulase/xylanase mixture No. 1: 6.0, glucanase: 7.0, and cellulase/xylanase mixture No. 2: 7.0) control for one hour at 130° F. with no intermittent mixing throughout the reaction. Thorough mixing took place at the initiation of the reaction, but no mixing was used throughout the remainder of the reaction time. After enzyme treatment, the pulps were bleached to approximately an 83 GE or TAPPI brightness. The bleached pulps were refined by a PFI Mill to a standard 35° S—R freeness and Tappi handsheet prepared. The handsheets were tested by an IGT testing instrument by IGT/Reprotest B.V. This instrument allows vessel picking to be observed and quantified. The results are set out in the following table:

TABLE 3

| Trial | Average Vessel Picks/cm$^2$ | Standard Deviation | % Reduction |
|---|---|---|---|
| Control | 4.0 | 0.8 | 0 |
| Cellulase/xylanase mixture #1 | 2.0 | 0.8 | 50 |
| Glucanase | 2.0 | 0.5 | 45 |
| Cellulase/xylanase mixture #2 | 1.2 | 0.9 | 70 |

All enzyme doses in Examples 3 and 4 were 0.10 percent on O.D. (oven dry) fiber.

EXAMPLE 5

The main objective of this mill trial was to duplicate the laboratory work using Pulpzyme HA, a cellulase/xylanase enzyme mixture, to reduce hardwood vessel picking without substantially reducing fiber strength. Specifically, the goal was to reduce vessel picking by a minimum of 55 percent.

Pulpzyme HA was added in dosages of 0.9 to 1.4 kg/ton of pulp to the brownstock hardwood pulp prior to high density storage. Sulfuric acid was added to maintain a pH of 7.0. Final stage pulp was sampled every four hours for a composite sample with grab samples taken three times a day. Fully bleached pulp samples were refined to 35° S—R by the refining mill. Vessel picking and strength tests were determined. The actual trial period was eight days (seven days of enzyme addition, a one day control (no enzyme addition) interval, followed by one day of enzyme addition).

FIG. 1 describes the results of vessel picking from samples taken during the trial. Some of the samples were daily composites and some were grab samples. Trial periods consistently reduced vessel picking by 75 to 100 percent. Paper machine and off machine coater data were also studied during the trial. Shallow picking (vessel picking) was reduced by 50 to 73 percent during the trial versus historical data.

Another quality of the pulp noticed during testing was that enzyme treated vessels are substantially smaller than untreated. This could affect the paper quality in two ways. The smaller vessels have less surface area than the larger ones. When ink is applied to the sheet, the smaller vessels and the ink may not produce enough tack to pick from the sheet. Secondly, the smaller vessels may also have a tendency to be imbedded further into the sheet than larger vessels, thus preventing surface picking.

One concern in using Pulpzyme HA is reducing pulp strength. No significant reductions were seen in pulp viscosity, tear, burst, breaking length or apparent density due to Pulpzyme HA use.

The Pulpzyme HA mill trial reinforced the results seen in the laboratory vessel pick reduction studies. Pulpzyme HA reduced mill vessel picking and possibly paper machine vessel picking by 75 to 100 percent. While reductions in vessel picking were consistently observed, no reductions in pulp viscosity or pulp strength were produced. Also, Pulpzyme HA addition may have also reduced combined first and second stage filtrate colors by as much as 15 percent.

What is claimed is:

1. A process for reducing unbleached hardwood vessel element picking in chemically digested hardwood pulps comprising treating unbleached hardwood brownstock pulp with an enzyme mixture comprised of cellulases and xylanases in an amount of about 0.5 to about 0.01 weight percent, based on the weight of the hardwood pulp, the mixture having a cellulase activity of at least 200 EGU/g, in a pH range of 7 to 8, at a temperature from about 100° to about 150° F. for a reaction time of about 30 to about 180 minutes, whereby the hardwood vessel element picking for pulps used in the printing or book publishing industry is substantially reduced.

2. The process for reducing unbleached hardwood vessel element picking in chemically digested hardwood pulps as claimed in claim 1, wherein the unbleached chemical hardwood pulp is produced from any chemical pulping process.

3. The process for reducing unbleached hardwood vessel element picking in chemically digested hardwood pulps as claimed in claim 2, wherein the pulp is unrefined before it is treated with the enzyme mixture.

4. The process for reducing unbleached hardwood vessel element picking in chemically digested hardwood pulps as claimed in claim 2, wherein the pulp is refined after it is treated with the enzyme mixture.

5. The process for reducing unbleached hardwood vessel element picking in chemically digested hardwood pulps as claimed in claim 1, wherein the pulp is unrefined before it is treated with the enzyme mixture.

6. The process for reducing unbleached hardwood vessel element picking in chemically digested hardwood pulps as claimed in claim 1, wherein the pulp is refined after it is treated with the enzyme mixture.

7. The process for reducing unbleached hardwood vessel element picking in chemically digested hardwood pulps as claimed in claim 1, further comprising bleaching, refining and converting the pulp into paper which will be used in the printing and writing industry, after the pulp is treated with the enzyme mixture.

8. The process for reducing unbleached hardwood vessel element picking in chemically digested hardwood pulps as claimed in claim 7, wherein the pulp is fully bleached to a GE or TAPPI brightness of a minimum of 80 about percent.

9. The process for reducing unbleached hardwood vessel element picking in chemically digested hardwood pulps as claimed in claim 7, wherein the treated pulp is intended for the production of paper which is suitable for printing with ink.

10. The process for reducing unbleached hardwood vessel element picking in chemically digested hardwood pulps as claimed in claim 1, wherein the pulp is made primarily from oak but may contain at least one member from the group consisting of maple, poplar, birch, aspen, chestnut, beech and walnut.

11. The process for reducing unbleached hardwood vessel element picking in chemically digested hardwood pulps as claimed in claim 1, wherein the enzyme mixture contains substantial amounts of both xylanases and cellulases.

12. The process for reducing unbleached hardwood vessel element picking in chemically digested hardwood pulps as claimed in claim 11, wherein the xylanases are from the group consisting of endo-xylanases and exo-xylanases.

13. The process for reducing unbleached hardwood vessel element picking in chemically digested hardwood pulps as claimed in claim 11, wherein the cellulases are from the group consisting of endo-cellulases or exo-cellulases.

14. The process for reducing unbleached hardwood vessel element picking in chemically digested hardwood pulps as claimed in claim 11, wherein the xylanases are from the group consisting of endo-1,4-beta-D-xylanase and exo-1,4-beta-D-xylanase.

15. The process for reducing unbleached hardwood vessel element picking in chemically digested hardwood pulps as claimed in claim 11, wherein the cellulases are from the group consisting of endo-glucanase, cellobiohydrolase, beta-glucosidase, acetyl esterase, pentosanase, and alpha-galactosidase.

16. The process for reducing unbleached hardwood vessel element picking in chemically digested hardwood pulps as claimed in claim 1, wherein the enzyme mixture is produced by *Trichoderma longibrachiatum*.

17. The process for reducing unbleached hardwood vessel element picking in chemically digested hardwood pulps as claimed in claim 1, wherein the xylanase activity is at least 200 XYU/g.

18. The process for reducing unbleached hardwood vessel element picking in chemically digested hardwood pulps as claimed in claim 1, wherein the xylanase activity is at least 300 XYU/g.

19. The process for reducing unbleached hardwood vessel element picking in chemically digested hardwood pulps as claimed in claim 1, wherein the cellulase activity is at least 300 EGU/g.

20. The process for reducing unbleached hardwood vessel element picking in chemically digested hardwood pulps as claimed in claim 1, wherein the enzyme mixture is in an amount of about 0.10 weight percent based on the weight of the hardwood pulp.

21. The process for reducing unbleached hardwood vessel element picking in chemically digested hardwood pulps as claimed in claim 1, wherein the pH is adjusted with either acid or alkali to said range of 7 to 8.

22. The process for reducing unbleached hardwood vessel element picking in chemically digested hardwood pulps as claimed in claim 1, wherein after an initial mixing the brown stock pulp stands in a container without mixing.

23. The process for reducing unbleached hardwood vessel element picking in chemically digested hardwood pulps as claimed in claim 22, wherein the pulps and the enzyme mixture are mixed at the beginning of the process, and then the pulps and the enzyme mixture are not mixed for the remainder of the reaction time.

24. The process for reducing unbleached hardwood vessel element picking in chemically digested hardwood pulps as claimed in claim 1, wherein the process reduces the hardwood vessel element picking in handsheets made from the pulp by 10 to 100 percent.

25. The process for reducing unbleached hardwood vessel element picking in chemically digested hardwood pulps as claimed in claim 1, wherein the process reduces the hardwood vessel element picking in handsheets made from the pulp by at least seventy percent.

* * * * *